US005436611A

United States Patent [19]

Arlinghaus, Jr.

[11] Patent Number: 5,436,611

[45] Date of Patent: Jul. 25, 1995

[54] RACE RECORDING AND DISPLAY SYSTEM

[76] Inventor: Frank H. Arlinghaus, Jr., Windmill La., Rumson, N.J. 07760

[21] Appl. No.: 89,367

[22] Filed: Jul. 9, 1993

[51] Int. Cl.[6] ..... G08B 23/00

[52] U.S. Cl. ..... 340/323 R; 340/941; 340/933; 368/2; 368/3; 368/10

[58] Field of Search ..... 340/323 R, 941, 933; 368/2, 3, 9, 10, 6; 235/377, 385; 346/107 B, 1.1

[56] References Cited

U.S. PATENT DOCUMENTS

| | | | |
|---|---|---|---|
| 3,596,103 | 7/1971 | Matthews | 340/323 R |
| 3,752,588 | 8/1973 | Chapman | 340/323 R |
| 3,795,907 | 3/1974 | Edwards | 340/323 R |
| 3,932,746 | 1/1976 | Swanson | 324/175 |
| 4,074,117 | 2/1978 | DeLorean et al. | 340/323 R |
| 4,142,680 | 3/1979 | Oswald et al. | 340/323 R |
| 4,315,242 | 2/1982 | Lueg et al. | 340/323 R |
| 4,449,114 | 5/1984 | Fascenda et al. | 340/988 |
| 4,571,698 | 2/1986 | Armstrong | 364/569 |
| 4,752,764 | 6/1988 | Peterson et al. | 340/323 R |
| 4,951,039 | 8/1990 | Schwendeman et al. | 340/825.44 |
| 4,999,604 | 3/1991 | Crews | 340/323 R |
| 5,091,895 | 2/1992 | Chatwin et al. | 340/323 R |
| 5,103,433 | 4/1992 | Imhof | 368/9 |
| 5,138,589 | 8/1992 | Kimbel | 340/323 R |
| 5,140,307 | 8/1992 | Rebetez et al. | 340/539 |
| 5,194,861 | 3/1993 | St. Clair | 340/323 R |
| 5,241,487 | 8/1993 | Bianco | 340/323 R |
| 5,245,162 | 9/1993 | Takahashi | 235/377 |

*Primary Examiner*—Brent Swarthout
*Assistant Examiner*—Nina Tong
*Attorney, Agent, or Firm*—Hoffmann & Baron

[57] ABSTRACT

A race recording and display system includes a detection station for detecting each participant in a race. The detection station has an array of detection signal transmitting devices and identifying signal receiving devices arranged over a race course in sufficient numbers to irradiate a portion of the course ensuring detection and identification of each participant traversing the station. Detection results from the reflection of a portion of a detection signal transmitted by each transmitting device sufficient to provide an identifying signal unique to each participant to each receiving device. Identifying means carried by each participant provides the identifying signal upon irradiation by a detection signal. Determining means responsive to each identifying signal relates the identifying signal to each participant, fixes a time of receipt of the identifying signal and generates an information signal for transmission to a display means. The display means responds to the information signal by displaying information regarding the status of the race.

15 Claims, 7 Drawing Sheets

RACE RECORDING AND DISPLAY SYSTEM

BACKGROUND OF THE INVENTION

This invention relates to a race recording system, and more particularly relates to a race recording and display system for determining the timing and relative position of a number of entries participating in a racing event and calculating and displaying race status information therefrom.

There are many known systems for identifying and timing a plurality of objects moving along a racing course or passing over a reference line and conveying the status of the identity and timing information to racing enthusiasts. Several conventional methods for conveying racing status information include direct audio announcement by a race observer, taking a photograph at the finish line of the racing course and direct observation of the race via spotters for a television broadcast. Such methods are limited at best and are at times unacceptable for fully apprising racing enthusiasts of race status information.

In the recent past, electronic techniques have developed to more readily identify and more accurately provide racing entry time and race status information. For example, U.S. Pat. No. 3,795,907 to Edwards discloses an electronic race calling system capable of determining the order and relative positioning of multiple race entries. The system includes a plurality of pickup loops stationed at call points around a fixed racing track. The loops co-act with transmitters carried by several race entries, the transmitters operating on distinct frequencies. Signals received by the loops are transferred over a common transmission line to individual channel logic sections where each entry is identified and the time interval between the entry's consecutive loop crossings is determined. The information is transferred and displayed on boards at a racetrack. Such a race calling system, however, is cumbersome and costly to adapt to lengthy racing courses. For example, cross-country races or long distance road rallies would require multiple loops at multiple positions along each racing course. Loops must be positioned within a track of the racing course in such a way as not to disturb racing entries passing over. This requires sophisticated equipment, intricate installation and great care.

In an apparent attempt to overcome difficulties arising from increasing numbers of race entries over a larger racing course, U.S. Pat. No. 5,140,307 to Rebetez et al. discloses an arrangement for identifying and timing a plurality of vehicles crossing over a reference line. The arrangement uses a radioelectric signal radiated by a transmitter-receiver at a fixed station that is modulated by a low frequency "synchronous" signal associated with a moving station mounted upon each vehicle. The arrangement allows for an instant determination of each vehicle passing over a reference line. A transmitter-receiver (moving station) within each vehicle receives the radioelectric signal from the fixed station, modulates the received signal with the low frequency signal, and transmits the modulated signal to the fixed station. The fixed station therefrom determines the identity and time of passage of each moving vehicle at the reference line in conjunction with a microcomputer. Although such a system may be accurate, it becomes costly to install a transmitter/receiver within a large number of vehicles participating in a racing event.

Accurate timing of each of a plurality of participants competing in an athletic racing event and calculating and communicating the related race status information has long been a challenge to racing coordinators. In a long distance running race, for example, multiple long distance runners are bunched or crowded together at the start of the race but thin out as the long distance race progresses. It is both impractical because of weight considerations and because of the cost to outfit each runner with a transmitter or transmitter/receiver. It is therefore difficult to accurately track each runner and display each runner's race status information during various portions of the race. Still, each individual runner's time and place information is crucial for a race reviewer to understand the scoring at different positions along the race, especially for a team-scored long distance running event.

Efforts to accurately time and record running athletes are known. For example, U.S. Pat. No. 4,752,764 to Peterson et al. discloses an apparatus which electronically times and records a running athlete traveling over a defined course. The apparatus includes a plurality of ultrasonic detectors positioned at predetermined intervals along the course. The detectors produce and transmit a sequence of ultrasonic signals which are reflected by the passing runner and received at respective detectors, transferred to an RF receiver in a video recording and timing apparatus to compute the lapsed time of each runner's travel. The runner's time is superimposed on a video recording allowing a runner's athletic ability to later be evaluated. The apparatus, however, falls short in its ability to time and record the progress of a plurality of runners along a defined course. The above-described apparatus is incapable of distinguishing between more than one runner on the racing course at one time.

It can be seen from the preceding discussion that conventional apparatus and methods for electronic timing and recording of moving entries participating in a racing event are unable to simply and economically determine timing and relative positioning information for individual and multiple racing entries traveling along various racing courses whereby such determined racing timing and positioning information can be communicated to interested racing viewers.

SUMMARY OF THE INVENTION

The present invention, which addresses the needs of the prior art, provides a race recording and display system for determining the time that racing participants arrive at various fixed positions along a racing course. The system then generates race status information from the participants' times and displays the status information for communication to racing viewers.

The race recording and display system includes a detection station for detecting each participant in a race having multiple participants. The detecting station includes an array of detection signal transmitting devices and identifying signal receiving devices fixed in an arrangement over a race course in sufficient numbers to detect each participant in the race. The transmitting devices radiate a detection signal towards the race course and the receiving devices receive a reflected portion of the detection signal in a form of an identifying signal as the participants traverse the detection station.

The system also includes unique identifying means carried by each race participant for providing the identifying signal upon irradiation by the detection signal. Determining means connected to each receiving device convert each identifying signal to an information signal. The information signal includes an identity of a detected participant and the time the participant passed the detection station. The determining means also include means for transmitting the information signal to a display means. Display means responds to the information signal generated by the determining means and display the information regarding the status of the race at each detection station.

In one embodiment, the detection signal transmitting devices are laser diodes, the identifying means are bar code reflectors correctly positioned on each participant, and the identifying signal receiving devices are photodiodes which detect at least a portion of a laser beam signal reflected from each identifying means carried by each participant.

The system may include one or more arrays placed at one or more fixed positions of the race course. Each array may be arranged such that the detection signal transmitting devices and identifying signal receiving devices may be mounted in banks in proximity with each other on, for example, an elongated support member positioned above the racing course. In such an arrangement, each of the devices within a bank of an array may be arranged at an angle facing a fixed position of the race course whereby the detection signal can be transmitted, reflected from each participant, and received in sufficient strength to provide an information signal carrying the identification information.

The method of the present invention for monitoring the progress of the participants in a race along a fixed race course includes the step of irradiating at least one position of the race course with an array comprising a sufficient number of detection signals to ensure that each participant will be irradiated. The method also includes the steps of reflecting a portion of at least one of the detection signals to provide an identifying signal sufficient to identify each participant, receiving each identifying signal reflected from each participant and determining the identification of each participant and a time that each participant traversed the detection station, and generating an information signal therefrom. The information signal may be transmitted to a display means for spectator viewing.

These and other objects, features and advantages of this invention will become apparent from the following detailed description of illustrated embodiments thereof, which is to be read in conjunction with the accompanying drawings.

DETAILED DESCRIPTION OF THE INVENTION

The preferred embodiment of the present invention will be described with respect to the identification and timing of each of a plurality of long distance runners competing on a race course, determining race status information therefrom, and communicating the information to a display for race viewers. It will be understood, however, that the present invention is not limited thereto and may be used in other applications in which it is desirable to electronically identify the time and position of moving objects, i.e., race participants, traveling along a defined race course, determining the relative positioning of the race participants and race status information therefrom, and communicating the race status information to spectators for viewing.

Figure 1A:
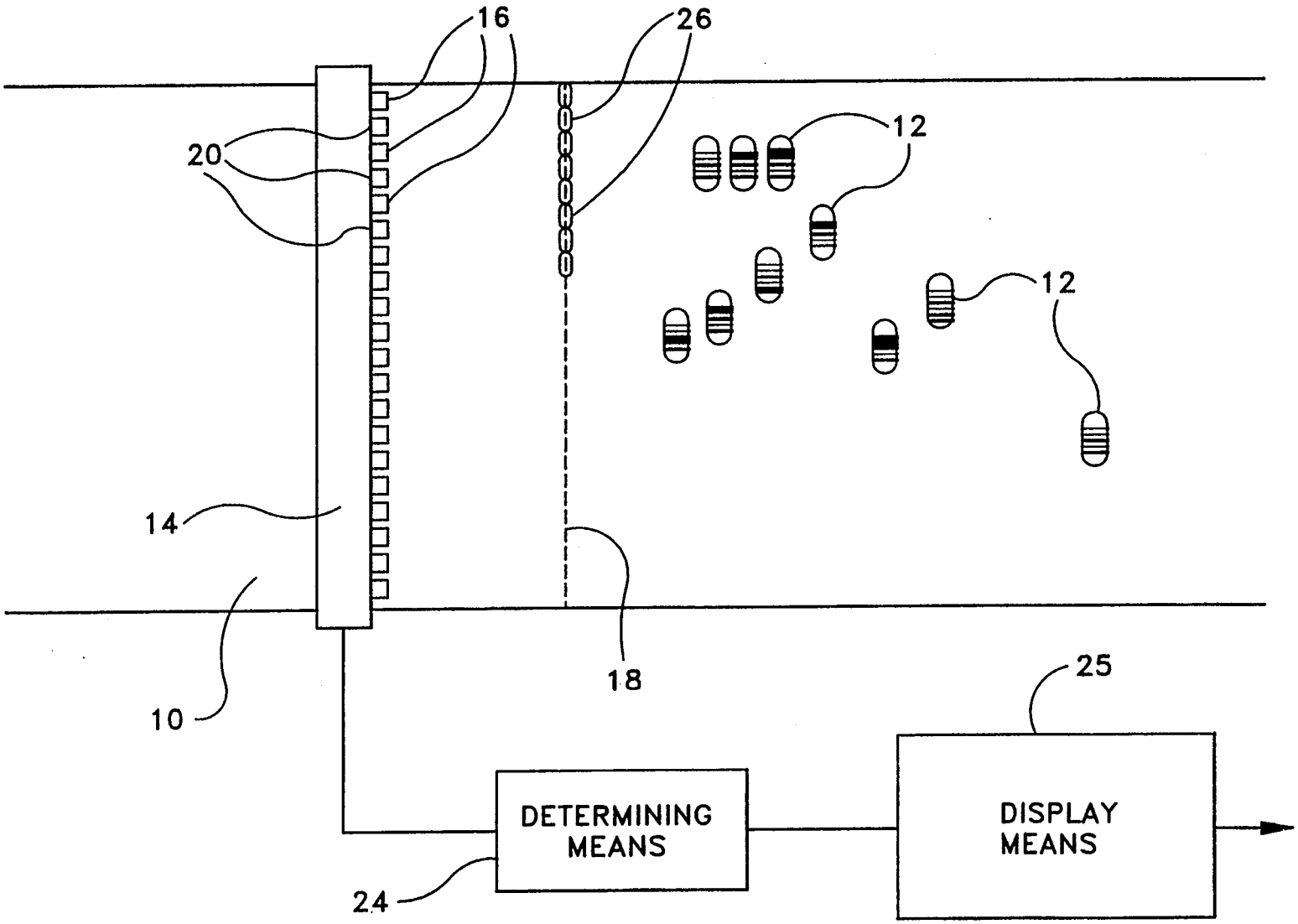
FIG. 1A is a top view of a portion of a racing course depicting one embodiment of the present invention.

FIG. 1A shows a top view of a portion of a race course 10 upon which a number of long distance runners 12 are traveling in competition. The movement of the long distance runners in FIG. 1A is from right to left in the figure. A first bank 14 of signal transmitting devices 16 and signal receiving devices 20 is shown erected above and traversing the portion of the racing course 10. All of the long distance runners 12 must travel under the first bank 14 in order to complete the competition.

The first bank 14 contains a plurality of transmitting devices 16 mounted in a manner such that a detection signal emitted from each transmitting device is directed at an angle $\theta$ (FIG. 5) downwards towards a fixed position of the race course 10. When the plurality of transmitting devices radiate, a shower of detection signals is formed irradiating the fixed position. The fixed position of the race course at which the array of detection signals is directed is designated as the crossing point 18. The crossing point 18 is shown in the figure interposed between the first bank 14 and the approaching runners 12. All long distance runners must traverse crossing point 18 to complete the long distance race.

Each runner displays an identifier 30 (to be discussed in greater detail below) to identify the runner to the race recording and display system. When each runner traverses the crossing point 18, the identifier is irradiated by the shower of detection signals emitted by the first bank 14. The irradiated identifier reflects a portion of the detection signal.

A plurality of receiving devices 20 are mounted upon the first bank 14. Each of the plurality of receiving devices may be juxtaposed to each of the plurality of transmitting devices 16. The receiving devices 20 are mounted in such a manner that a receiving aperture (not shown in the figure) within each receiving device 20 is directed at an angle $\theta$ (FIG. 5) towards the crossing point 18. The receiving devices receive an identifying portion of the detection signal reflected from the crossing point in a form of an identifying signal. Accordingly, this embodiment allows the race recording and display system to radiate a detection signal downwards towards the runners at angle $\theta$ and receive an identifying signal reflected at the same angle $\theta$. Each transmitting device transmits and directs a separate detection signal to irradiate a limited cross-sectional area 26 of racing course 10 at crossing point 18.

Figure 1B:
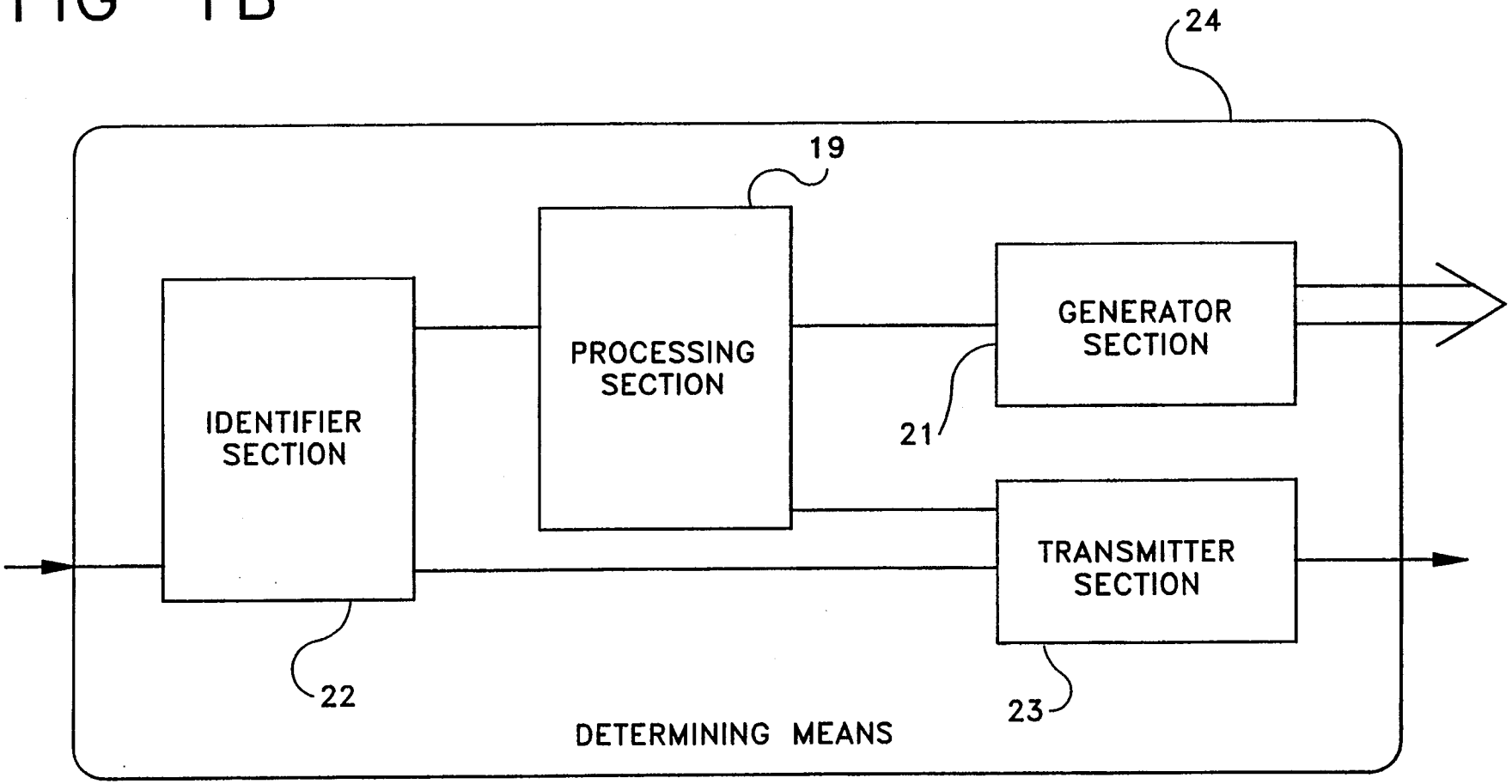
FIG. 1B is a block diagram of a determining means of the present invention.

The plurality of receiving and transmitting devices are each electrically connected to a determining means 24, shown in greater detail in FIG. 1B. The determining means generates the detection signal within a generator section 21 for transmission by each transmitting device 16. An identifier section 22 within the determining means 24 receives the identifying signal reflected from each of the long distance runners, i.e., from each identifier 30, at or near the crossing point 18. The determining means 24 also includes a processing section 19 wherein the received identifying signals are processed in order to generate an information signal. A transmitter section 23 within the determining means is able to transmit an information signal generated within the processing section 19 in accordance with a received identifying signal. The determining means 24 may be a transceiver or like device known to those skilled in the art.

Once a receiving device 20 receives an identifying signal reflected from a runner 12, the identifier section 22 identifies each identifier 30 from which each identifying signal was reflected and a detection time associated with the identifying signal. The processing section 19 then generates a timing signal in accordance with the information. Each timing signal identifies each runner and that runner's time. The processing section 19 may further process each timing signal and generate an information signal containing the race status information which may then be output by transmitting means 23 to display means 25.

The processing section 19 within determining means 24 may be implemented by any means known to those skilled in the art. For example, a microcontroller and necessary hard-wired logic may be utilized to generate the timing signals and identify each runners time and relative place information at a crossing point 18. The processing section would then generate an information signal for transmission by the transmitter section 23.

The race status information may consist merely of a runner's lapsed time at the crossing point 18. However, the information signal may also include the runner's relative race position and may include team scoring information if the race is a team event. All race status information is calculated in accordance with the timing signal associated with each runner relative to crossing point 18. The determining means 24 then transmits the information signal associated with each runner and/or team to display means 25. Display means 25 communicates the race status information for spectator viewing or makes the race status information available to means of mass communication (not shown). Display means 25 should be located within viewing distance of the majority of race spectators.

Figure 2A:
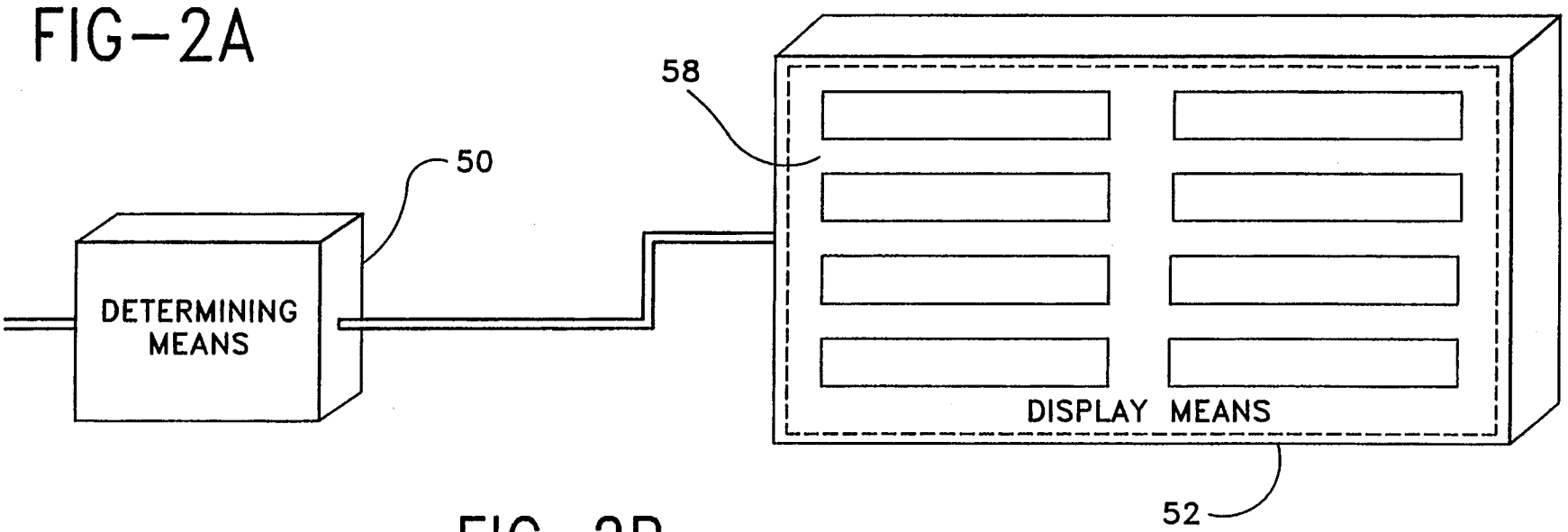
FIG. 2A is a block diagram showing determining means electrically connected to a display of the present invention.

FIG. 2A, like FIG. 1A, shows an embodiment of the present invention in which a determining means 50 is electrically connected to a display means 52. Display means 52 receives an information signal containing the race status information and displays the race status information, e.g., runner and runner time information, on a display face 58 for public viewing. Because certain long distance races draw a particularly large number of participants, the set of all runners and their associated racing status information at each crossing point 18 can be lengthy. To accommodate such numbers, the race recording and display system may scroll each runner's racing status information on display face 58 several times before calculation of a next update of race status information.

In cases where team scoring is important, determining means 50 is capable of calculating team scoring information for display from a compilation of each individual runner's time as contained in its associated timing signal. Determining means 50 then transfers an information signal containing the race status information to the display means 52. Team scoring information may then be displayed upon display face 58 for spectator viewing. The aesthetic design of the display face 58 of determining and display means 52 is not limited to that depicted in FIG. 2A.

Figure 2B:
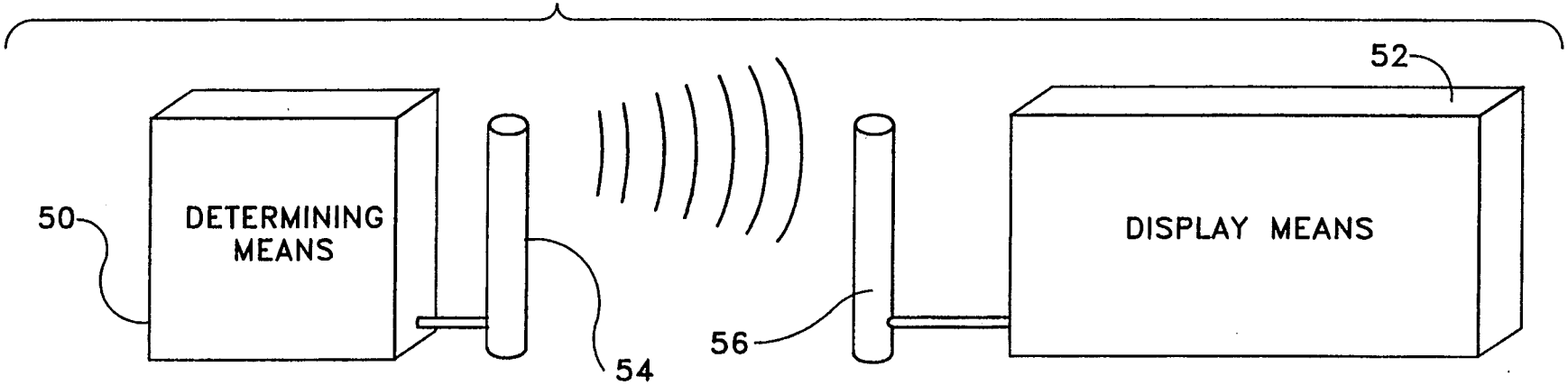
FIG. 2B is a block diagram showing determining means electrically coupled to a transmitting antenna, and a receiving antenna electrically coupled to a display of the present invention.

FIG. 2B shows an embodiment of the present invention in which determining means 50' is coupled to a transmitting antenna 54. Transmitting antenna 54 radiates the information signals generated within determining means 50 (FIG. 2A) into space. The transmitted information signals are received by a receiver antenna 56, electrically coupled to display means 52'. Such an arrangement avoids the need for a direct electrical connection between the determining means 50' and display means 52' (FIG. 1).

Figure 3:
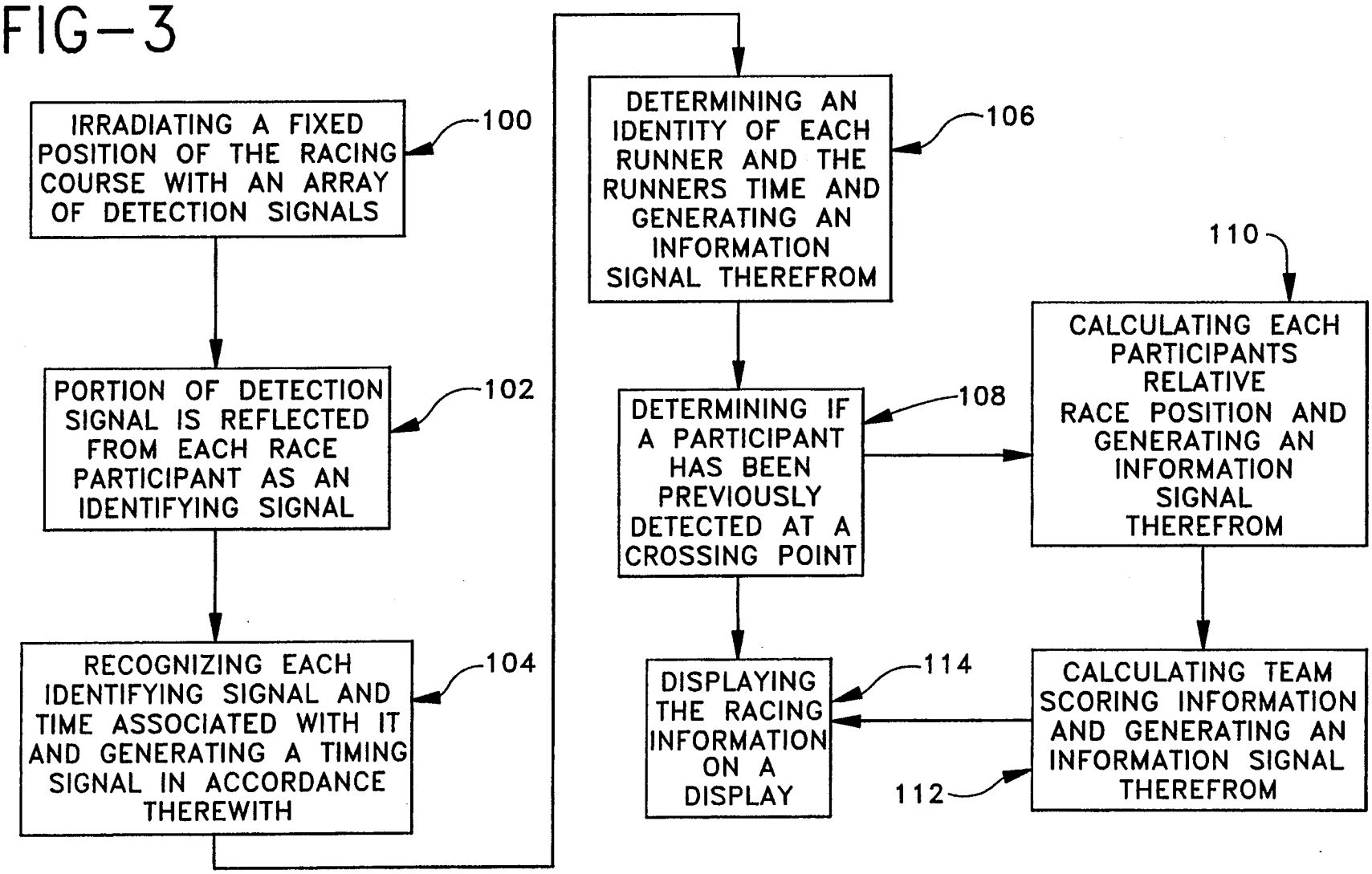
FIG. 3 is a flow diagram defining the steps performed by one embodiment of the present invention for detecting and displaying racing participant status information.

FIG. 3 is a flow diagram depicting the steps performed by the present invention for detecting and displaying racing participant status information. Step 100 is a step of irradiating a fixed position of the racing course with the array of detection signals. Step 102 is a step by which a portion of the array of detection signals is reflected from each race participant as an identifying signal. Step 104 is a step in which each identifying signal and the time associated with the identifying signal is recognized and a timing signal is generated according thereto. In step 106, an identity of each participant and that participant's associated time is determined and an information signal is generated according thereto.

The information signal generated within step 106 may consist merely of the participant's lapsed time at the crossing point 18. Step 114 is a step by which racing information contained within the information signal is displayed on a display. However, before displaying the racing information (i.e., performing step 114), it should be determined whether a participant has been previously detected at the crossing point (to be discussed in greater detail below). If the participant was not previously detected, the racing information is displayed, i.e., step 114 is performed.

FIG. 3 also shows several optional steps which may be performed by the system. Optional step 110 includes calculating each participant's relative position in the race and generating an information signal therefrom. Optional step 112 includes calculating team scoring information from individual participant information and generating an information signal therefrom. The race status information contained within the information signal may then be displayed according to step 114.

Figure 4B:
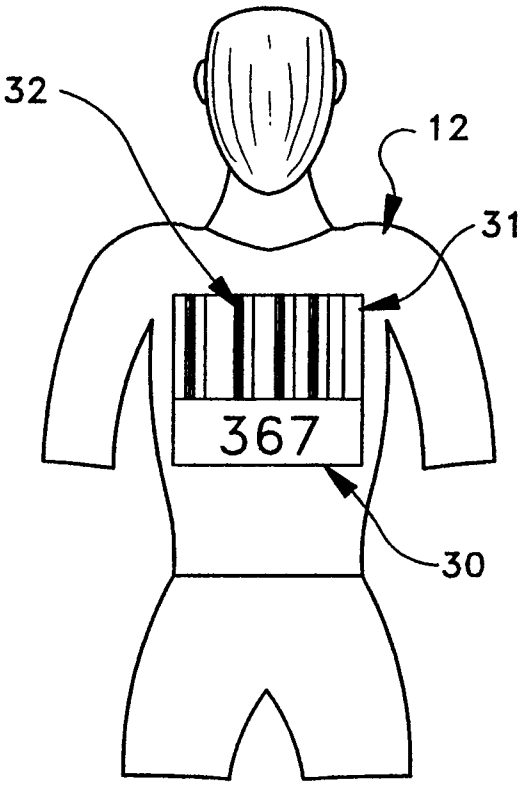
FIG. 4B is rear view of the participant shown in FIG. 4A.
Figure 4A:
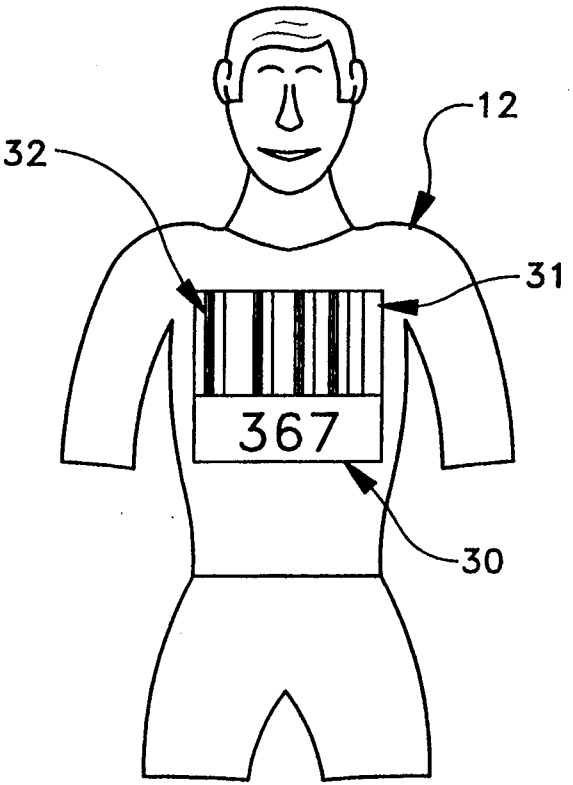
FIG. 4A is a front view of a racing participant displaying an identifying means of the present invention.

FIGS. 4A and 4B show one embodiment of the identifying means that are carried by each runner 12 during the race. In this preferred embodiment, the identifying means is an upper body wearing apparel 30. The wearing apparel, i.e., identifying means 30, has a reflector portion 1, embossed with a reflective bar code symbol 32. The reflector portion 31 is shown positioned in the upper chest and upper back areas of the runner 12. Placement of the reflector portion 31 on the runner 12 in this manner assures that the bar code symbol 32 will be irradiated by the array of detection signals emitted at angle $\theta$ from first bank 14 as the runner passes the crossing point 18. When the reflective bar code symbol 32 is irradiated by a detection signal, the detection signal is modified and reflected back towards array 14 as an identifying signal for receipt by the receiving devices 20. The wearing apparel 30 can be a shirt embossed with the reflective bar code symbol 32 or an overgarment draped over the runner.

To activate the reflective bar code symbol 32, the race recording and display system must use a laser diode as the detection signal transmitting device. One example of a laser diode for use with the present invention is the NDL3200 670 nm visible laser diode produced by NEC Corporation of Japan. Consequently, each of the plurality of identifying signal receiving devices must be able to detect the reflected bar code identifying signal. A NDL2102 photodiode, also provided by NEC Corporation of Japan, may be used as an identifying signal receiving device.

Operation of the above-described embodiment is as follows. Each laser diode (detection signal transmitting device 16) radiates a visible laser beam (detection signal) towards each area 26 of racing course 10 at crossing point 18. The combined effect of all the beams (detection signals) radiated from the first bank 14 of transmitting devices 16 is the formation of a beam pattern, i.e., a shower of detection signals. The shower of laser beam detection signals irradiates the total transverse cross section of the race course 10 at crossing point 18. Each area 26 at crossing point 18 is less than a width of a normal sized runner 12. Consequently, each runner in a line of runners traversing crossing point 18 is irradiated.

A portion of the shower of laser beam detection signals irradiating each section 26 of crossing point 18 is reflected by the identifier means 30, i.e., bar code symbol 32, carried by each runner 12 as the runner traverses the crossing point. The reflected portion is directed back towards the first bank 14 in the form of an identifying signal for receipt by any of photodiodes (identifying signal receiving devices) 20. Since only one runner can traverse each crossing point at once, the present embodiment will identify each runner and fix the runner's time at the crossing point 18 regardless of how many runners 12 are participating.

The angle of incidence at which the energy transmitting and receiving devices are positioned (i.e., angle $\theta$) allows the race recording and display system to irradiate and identify multiple consecutive runners 12 traversing the crossing point 18 under normal running conditions. The plurality of receiving devices 20 therefore receive the identifying portion, i.e., identifying signal, of the reflected detection signal. Error free detection of the runners passing the crossing point 18 can thereby be achieved.

Figure 5:
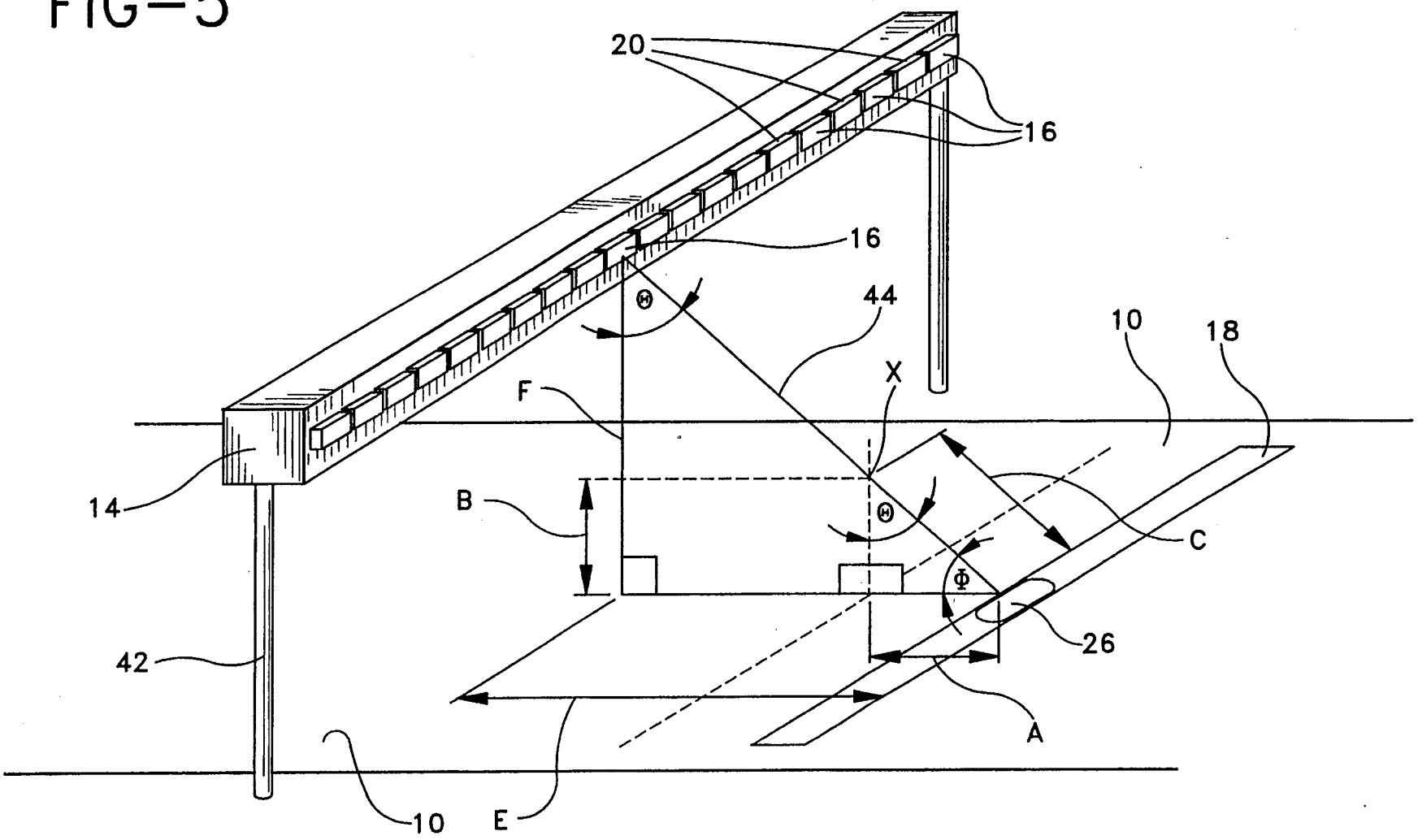
FIG. 5 is a diagram showing a side perspective view of one embodiment of a detection station of the present invention.

FIG. 5 shows a side perspective view of a first bank 14 of transmitting and receiving devices of the present invention positioned proximate to a crossing point 18.

Two support members 42 are shown in the figure at the edges of the racing course 10. The two support members 42 support the first bank 14 in its position above the racing course 10. A beam of a detection signal 44 transmitted from one transmitting device 16 mounted on the first bank 14 is shown incident at an angle $\theta$ upon cross-sectional area 26 at crossing point 18. Angle $\theta$ is relative to a normal extending from a bottom surface of the first bank 14 perpendicular to the surface of racing course 10.

Although a beam, such as beam 44, of each detection signal radiated from each transmitting device 16 is directed at crossing point 18, the identifying means 30 carried by each runner is actually irradiated at some distance A between the crossing point 18 and the first bank 14. The position of actual irradiation may be referred to as the detection point, identified by an X in the figure.

A portion of the detection signal (i.e., beam 44) is reflected from identifying means 30 at detection point X rather than crossing point 18 because of the positioning of each identifying means upon the upper body of each runner 12, a distance B from the racing course 10. Detection signal beam 44 is directed to the racing course surface 10. The length of beam 44 between the identifying means 30 irradiated at detection point X and the crossing point is identified as a C. Distances A, B and C form a first right triangle.

The first right triangle is similar to a second right triangle. The second right triangle is formed of three legs, a first of which being equal to distance F between first bank 14 and the racing course surface 10. A second leg is equal to the distance E between crossing point 18 and the point at which the normal intersects racing surface 10. A third leg is equivalent to a distance traveled by beam 44 between crossing point 18 and each transmitting device at first bank 14, i.e., the hypotenuse of the second triangle. Because the first and second triangles are similar triangles, angle $\theta$ is equal to angle $\phi$.

The exact length of beam 44, the third leg of the second triangle, is known because some portion of the detection signal comprising beam 44 and radiated towards crossing point 18 is always reflected back from the race course surface 10. By knowing the time for the return of beam 44 in the form of the identifying signal, the distance travelled by beam 44 is known.

The length of leg C of the first triangle is proportional to the time difference between the time receipt of signal energy reflected back from the crossing point 18 and the time receipt of signal energy reflected back from detection point X. The exact distance A may be determined from C and angle $\theta$. Knowing C and angle $\theta$ allows A to be computed because $A = C \cos \theta$.

Any difference in the detection position of each runner because of, for instance, different runner heights, results in a slight detection time difference due to different detection points X for each runner. Varying detection point X varies the relative race course position at which each runner is irradiated by the shower of detection signals. The race recording and display system, however, can determine such differences and determine the exact time that each irradiated runner crossed the crossing point 18. By doing so, the race recording and display system compensates for height differences between the individual runners.

The unique method of detecting runners whereby each runner is irradiated by an array of detection signals at an angle $\theta$ provides for substantially error free detection. During a competition, runners traversing the crossing point 18 in line must always have a minimum distance between them. This minimum distance is proportional to the reach of a first runners legs rearward as the runner moves forward, combined with a forward reach of the legs of a second runner immediately behind the first. Because of this distance and the angle of irradiation, $\theta$, each runner will almost never be blocked from the irradiating shower of detection signals directed at the crossing point.

A number of corresponding crossing points 18 may be defined along a racing course using the race recording and display system of the present invention. Each crossing point requires at least one bank of detection signal transmitting devices and identifying signal receiving devices in an array positioned proximate to each crossing point 18. The greater the number of crossing points of a race, the more frequent the update of racing information. For example, one race recording and display system may include 8 crossing points positioned at $3\frac{1}{4}$ mile intervals along a 26 mile racing course. There will be a system update of racing status information at each $3\frac{1}{4}$ mile point in the race. In such a manner, long distance racing spectators may track progress of their favored long distance runners or long distance running teams with information updates after each $3\frac{1}{4}$ miles of racing course traversed by the runners.

Figure 6:
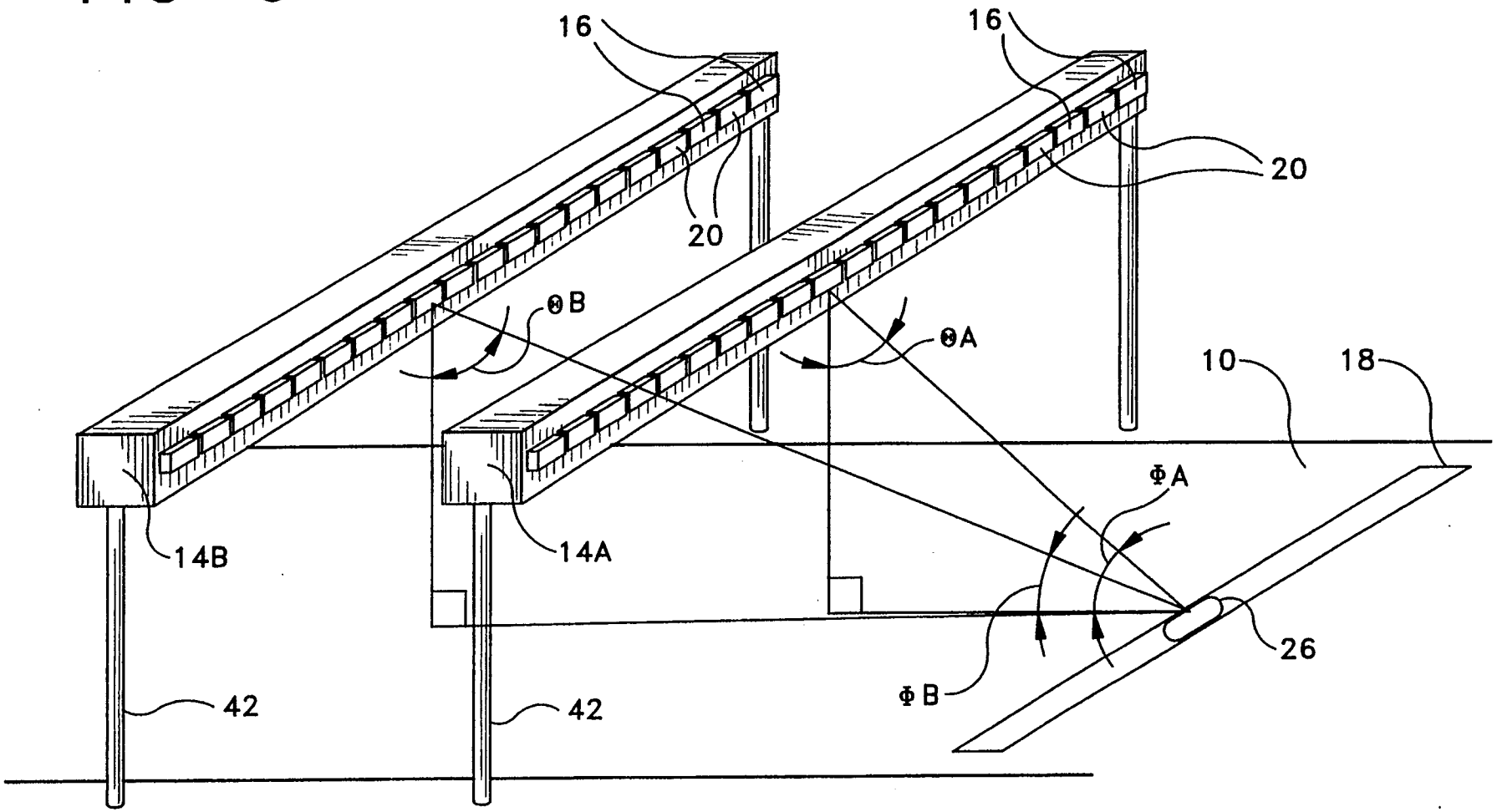
FIG. 6 is a diagram showing a side perspective view of another embodiment of a detection station of the present invention.

In another preferred embodiment, the present invention includes the possibility of system redundancy by provision of additional banks of transmitting and receiving devices in parallel. FIG. 6 shows a first bank 14*a* with a second bank 14*b* positioned proximate to and in parallel with the first bank. By providing two banks of combined detection signal transmitting devices and identifying signal receiving devices at each of multiple crossing points 18, error free runner identification and timing is provided by the present invention.

The transmitting devices 16 of first bank 14*a* irradiate cross-sectional area 26 at an angle $\theta_a$. The transmitting devices 16 of the second bank 14*b* irradiate cross-sectional area 26 at an angle $\theta_b$. Each plurality of transmitting devices may generate a distinct signal. Two identifying signals are reflected back towards the first and second banks, respectively. Each plurality of receiving devices within each of the first and second banks 14*a* and 14*b*, receive distinct identifying signals but both distinct signals carry identification information identifying the same runner. The corresponding identifying signals are processed at the identifier section of a transceiver 24, where only one timing signal is generated and provided to determining means 25 for the runner. The difference between angles $\theta_a$ and $\theta_b$ prevents the blocking by the first bank 14*a* of the detection signals transmitted by second bank 14*b*. This inclusion of system redundancy within the present invention ensures extremely accurate detection and timing of runners at the crossing points 18.

The redundancy aspect can be even further enhanced by offsetting the placement of the transmitting and receiving devices of the second bank 14*b* from those in the first bank 14*a* of transmitting and receiving devices. In addition, the placement of a second bank is not limited to its positioning as shown. The second bank 14*b* may be placed to irradiate the runners moving away from the second bank, i.e., their backs, or any variation thereof. The effect of any such arrangement is the creation of a shower of detection signals which will ensure that each participant is irradiated and identified.

The present invention is not limited by the arrangement or numbers of transmitting and receiving devices. Rather the key element is the creation of a shower of detection signals which ensures that no runner passes without being irradiated and identified. Moreover, once a runner is identified at any station along the course, the system of the present invention in programmed to reject any further input relating to the identified runner.

To prevent runners from being detected more than once at one crossing point 18, the determining means assimilates the runner's time into a memory contained store of complete race status information. Because the crossing points are spaced throughout a race, there is a known average time for runners between crossing points. A timing signal containing a runner's detected time at a crossing point is always compared to its prior crossing point detection time. If the second detected crossing time is illogically close to the first crossing point detection time, indicating a detection redundancy, either the first or second detection times will be ignored by the system.

The racing status information provided by the present invention can pique and hold a larger spectator audience. Increasing viewer demand for access to racing status information of particular forms of racing would surely follow. The racing status information may be transferred using the present invention to means of mass communication, such as television or radio transmitting stations and thereby reach an even larger receiver audience.

Thus, while there have been described what are presently believed to be preferred embodiments of the present invention, those skilled in the art will realize that other and further modifications and changes can be made without departing from the spirit of the invention, and it is intended to include all such changes and modifications as fall within the true scope of the invention as set forth in the following claims.

What is claimed is:

1. A recording and display system for a cross-country running race comprising:

a plurality of detection stations positioned at set distances along a cross-country race course, each said detection station detecting each of a plurality of participants in said cross-country race, each of the detection stations including an array, said array comprising a plurality of detection signal transmitting devices and a plurality of identifying signal receiving devices being arranged in a bank, and in sufficient numbers supported over said race course to avoid physically interfering with said participants and to ensure detection of each of said participants in the race conducted on said course by detection of at least a portion of a detection signal energy radiated from said transmitting devices towards said race course, reflected from each of said participants, and received as an identifying signal by said signal receiving devices when each of said participants traverse under said array of said detection station;

said system further including a backup array of detection signal transmitting and receiving devices being arranged in a second bank, wherein said array and said backup array are mounted on elongated support members erected above said race course and are parallel to each other the back-up array providing enhanced reliability to ensure detection of each of said race participants as they traverse the detection station;

a determining means electrically connected to each of said identifying signal receiving devices for converting said identifying signals received at respective identifying signal receiving devices to an information signal which includes an identity of a detected participant, a time and a relative position when said detected participant traversed said detection station, said determining means further including means for calculating a team scoring based upon the relative position of each of said race participants; and a display means for displaying the identity, time, and relative position of each of said race participants and said team scoring at each of said plurality of detection stations along the cross-country race course for continuously monitoring a race status.

2. The race recording and display system of claim 1, wherein said array of detection signal transmitting devices and identifying signal receiving devices further comprises at least one bank of said signal transmitting devices and signal receiving devices mounted on an elongated support member, said elongated support member positioned at a distance sufficiently above said race course to avoid physically interfering with said participants.

3. The recording and display system of claim 1, wherein each of said plurality of detection signal transmitting devices includes an infrared laser and each of said plurality of identifying signal receiving devices includes a bar code reader.

4. A race recording and display system, comprising:

(a) a detection station for detecting each of a plurality of participants in a race, the detection station having a first array which includes a plurality of detection signal transmitting devices and a plurality of identifying signal receiving devices being arranged in a first bank supported over a race course to avoid physically interfering with said participants and to detect each of said participants by detection of a portion of detection signal energy radiated towards said race course by said transmitting devices and reflected from each of said participants and received at said signal receiving devices as an identifying signal when each of said plurality of participants traverse said detection station, the detection station further including a backup array of detection signal transmitting and identifying signal receiving devices being arranged in a second bank parallel to said first bank, wherein said array and said backup array are positioned upon elongated support members erected above said race course, and wherein each of said first and second bank is directed to radiate energy to a fixed position of said course, the first and second banks irradiating said fixed position at a first and second angle, respectively, whereby the difference between the first and second angle for irradiating the fixed position ensures detection of said reflected radiated energy by said signal receiving devices;

(b) identifying means carried by each of said participants for providing said identifying signal upon being irradiated by said detection signal energy;

(c) determining means connected to each of said identifying signal receiving devices for converting each received identifying signal to an information signal which defines an identity of each detected said participant and a time when said detected participant traversed said detection station, said determining means further comprising means for transmitting said information signal; and (d) display means responsive to said transmitted information signal for displaying information regarding a relative position and time of each said participant of said race at said detection station.

5. The race recording and display system as defined by claim 4, wherein said array of detection signal transmitting devices and identifying signal receiving devices further comprises at least one bank of said signal transmitting devices and signal receiving devices mounted upon and forming an elongated support member, said elongated support member positioned over said race course at a distance sufficiently above said race course to avoid physically interfering with said participants.

6. The race recording and display system as defined by claim 5, wherein said bank comprises each of said plurality of detection signal transmitting devices juxtaposed to each of said plurality of identifying signal receiving devices.

7. The race recording and display system as defined by claim 4, wherein said identifying means includes a bar code reflector.

8. The race recording and display system as defined by claim 7, wherein said identifying means is incorporated into an article of upper body wearing apparel of each of said participants.

9. The race recording and display system as defined by claim 4, wherein each of said detection signal transmitting devices includes an infrared laser and each of said identifying signal receiving devices includes a bar code reader.

10. The race recording and display system as defined by claim 4, wherein said determining means comprises a transceiver, the transceiver including a generator section for generating said detection signal energy reflected from each of said participants, an identifier and processing section for receiving said identifying signals and a transmitting section for transmitting said information signals.

11. The race recording and display system according to claim 4, further comprising:

a transmitting antenna electrically connected to said determining means for transmitting said information signal; and a receiving antenna electrically connected to said display means for receiving said information signal and displaying a scoring information therefrom.

12. The race recording and display system according to claim 4, which includes at least two detection stations positioned at separate, predetermined locations along said race course.

13. A method for monitoring the progress of a number of race participants in a race along a fixed race course, comprising the steps of:

(a) irradiating a radiation signal energy to a fixed position of said course with a first and second array arranged parallel to each other in the form of a first and second bank, each said array comprising a plurality of identifying signal receiving devices and detection signal transmitting devices, wherein said detection signal transmitting devices of the first array transmit said radiation signal energy at a first angle and the second array transmits said radiation signal energy at a second angle to thereby ensure that each of said race participants traversing said fixed position will be irradiated, said first and second arrays being supported over said race course to avoid physically interfering with said race participants;

(b) reflecting a portion of said irradiated detection signal energy from each said race participants to provide an identifying signal sufficient to identify each said race participant when said participant crosses said fixed position;

(c) receiving each said portion of said identifying signal reflected from each said race participant by said first and second arrays at any of a number of identifying signal receiving devices;

(d) determining an identification of each said race participants and a time each of said race participants traversed said detection station; and (e) generating an information signal therefrom according to said irradiating step, said reflecting step, said receiving step and said determining step.

14. The method defined by claim 13, wherein the step of reflecting includes reflecting said irradiated detection signal energy from an identifier means affixed to each said participant for interaction with said detection signal energy.

15. The method defined by claim 13, further including the step of transmitting said information signal to a display means for displaying a race information which is contained in said information signal.

* * * * *